US005414418A

United States Patent [19]

Andros, Jr.

[11] Patent Number: 5,414,418

[45] Date of Patent: May 9, 1995

[54] METHOD AND APPARATUS FOR PRE-PROGRAMMING AND SUBSEQUENTLY DESIGNATING A RESPONSE CHARACTERISTIC OF A SELECTIVE CALL RECEIVER

[75] Inventor: Richard P. Andros, Jr., Coral Springs, Fla.

[73] Assignee: Motorola, Inc., Schaumburg, Ill.

[21] Appl. No.: 55,091

[22] Filed: May 3, 1993

[51] Int. Cl.[6] ..... G08B 5/22

[52] U.S. Cl. ..... 340/825.44; 340/825.47; 340/825.31

[58] Field of Search ..... 340/825.44, 825.47, 340/825.48, 825.22, 825.31, 825.56, 311.1; 455/38.2, 38.4; 379/56, 57, 58

[56] References Cited

U.S. PATENT DOCUMENTS

| | | | |
|---|---|---|---|
| 4,422,071 | 12/1983 | de Graaf | 340/825.44 |
| 4,860,005 | 8/1989 | DeLuca et al. | 340/825.44 |
| 4,894,649 | 1/1990 | Davis | 340/825.44 |
| 4,910,510 | 3/1990 | Davis et al. | 340/825.44 |
| 4,975,693 | 12/1990 | Davis et al. | 340/825.44 |
| 5,012,234 | 4/1991 | Dulaney et al. | 340/825.44 |
| 5,025,252 | 6/1991 | DeLuca et al. | 340/825.44 |
| 5,117,449 | 5/1992 | Metroka et al. | 379/58 |
| 5,117,460 | 5/1992 | Berry et al. | 381/41 |
| 5,146,217 | 9/1992 | Holmes | 340/825.44 |

OTHER PUBLICATIONS

Advisor Message Receiver, 6 pages, © 1990 by Motorola, Inc.

Motorola, Mar., 1986, Minitor II Alert Monitor Receiver Ordering Guide RO-05-102, pp. 1-2.

Motorola, Inc. Paging & Telepoint Systmes, "Bravo Express" Series, Pager programming Software Software User's Guide & Programmer Maintenance Manual, 68P81012B91-0 pp. 2-3, 22-23.

*Primary Examiner*—Michael Horabik
*Assistant Examiner*—Edwin C. Holloway, III
*Attorney, Agent, or Firm*—R. Louis Breeden

[57] ABSTRACT

A method and apparatus user-tailor a response characteristic of a selective call receiver (108) having a memory (221) and a user control interface (216). The memory (221) is pre-programmed (402) through a programming port (218) to store a plurality of user identifiers (324) and associated response profiles (328, 330), and thereafter a request element (304) requests (406) that a user identifier be designated. In response, a user designates the user identifier through the user control interface (216), and a response control element (308) controls (414) the selective call receiver (108) to respond in accordance with the pre-programmed response profile (328, 330) associated with the designated user identifier.

25 Claims, 4 Drawing Sheets

METHOD AND APPARATUS FOR PRE-PROGRAMMING AND SUBSEQUENTLY DESIGNATING A RESPONSE CHARACTERISTIC OF A SELECTIVE CALL RECEIVER

FIELD OF THE INVENTION

This invention relates in general to selective call receivers, and more specifically to selective call receivers having programmable addresses and response characteristics.

BACKGROUND OF THE INVENTION

Selective call receivers, i.e., radio pagers, having addresses and response options that can be programmed in the field are well known by paging service providers. Typically a service provider programs the address and response options of a selective call receiver at the time service is started for each individual user. The address corresponds uniquely with a number, e.g., a telephone access number, dialed to send a selective call message intended specifically for the user. The response options are programmed according to the single, individual user's requirements, and may include such options as a custom alert tone sequence, a silent vibratory alert, and the selection of tone-only, voice, or display functionality. Once programmed, the selective call receiver responds to the specific address and with the specific response options assigned uniquely to the single, individual user.

Many organizations provide selective call receivers for their employees to use during business hours. Many such organizations also operate in multiple shifts, in which most or all of the employees are not the same people as those in another shift. Often, for economic reasons, it is desirable for the employees of all shifts share a single, common group of selective call receivers. Because a selective call receiver address is typically associated with a specific access number used by a caller to page a specific person, each employee must locate his or her specific selective call receiver for use during the shift. This can cause problems if, for example, a first-shift employee has to work beyond the end of the first shift, or if an employee occasionally forgets and takes a selective call receiver home accidentally. Also, if a selective call receiver is taken out of service for repair, obtaining a functionally equivalent replacement selective call receiver can be a problem. In addition, an employee on one shift may require response options different from those of a counterpart receiver user on another shift. For example, a maintenance person may prefer a pager having voice functionality, while a supervisor may prefer a pager having numeric display functionality. Because conventional selective call receivers are programmed for only a single user's needs, such receivers are not readily adaptable for these special needs imposed by shared use.

Thus, what is needed is a way of sharing selective call receivers among employees without having to contend with the problems described above.

SUMMARY OF THE INVENTION

One aspect of the present invention is a method of user-tailoring a response characteristic of a selective call receiver having a memory and a user control interface. The method comprises the steps of pre-programming the memory to store a plurality of user identifiers and response profiles, each user identifier associated with a response profile, and requesting thereafter designation of a user identifier. The method further comprises designating in response thereto a user identifier through the user control interface, and controlling the selective call receiver to respond in accordance with the pre-programmed response profile associated with the designated user identifier.

Another aspect of the present invention is an apparatus for user-tailoring a response characteristic of a selective call receiver having a memory and a user control interface. The apparatus comprises a programming port for coupling the selective call receiver to a programmer for pre-programming the memory to store a plurality of user identifiers and response profiles, each user identifier associated with a response profile. The apparatus further comprises a request element within the selective call receiver for requesting designation of a user identifier, and a designation element coupled to the request element for designating a user identifier through the user control interface. The apparatus further comprises a response control element coupled to the designation element for controlling the selective call receiver to respond in accordance with the pre-programmed response profile associated with the designated user identifier.

Another aspect of the present invention is a selective call receiver, comprising a receiver element for receiving radio signals including a selective call address. The selective call receiver further comprises a processor coupled to the receiver element for decoding the received selective call address, and a memory system coupled to the processor for storing both pre-programmed data and the received information. The selective call receiver further comprises a user control interface coupled to the processor for providing control of the selective call receiver by a user, and an alert element coupled to the processor for alerting the user in response to the received selective call address. The selective call receiver further comprises an apparatus for enabling user-tailoring of a response characteristic of the selective call receiver. The apparatus comprises a programming port coupled to the processor for coupling the processor to an external programmer to pre-program the memory system to store a plurality of user identifiers and response profiles, each user identifier associated with a response profile. The apparatus further comprises a request element coupled to the processor for requesting designation of a user identifier, and a designation element coupled to the request element for designating a user identifier through the user control interface. The apparatus further comprises a response control element coupled to the designation element for controlling the selective call receiver to respond in accordance with the pre-programmed response profile associated with the designated user identifier.

DESCRIPTION OF THE PREFERRED EMBODIMENT

Figure 1:
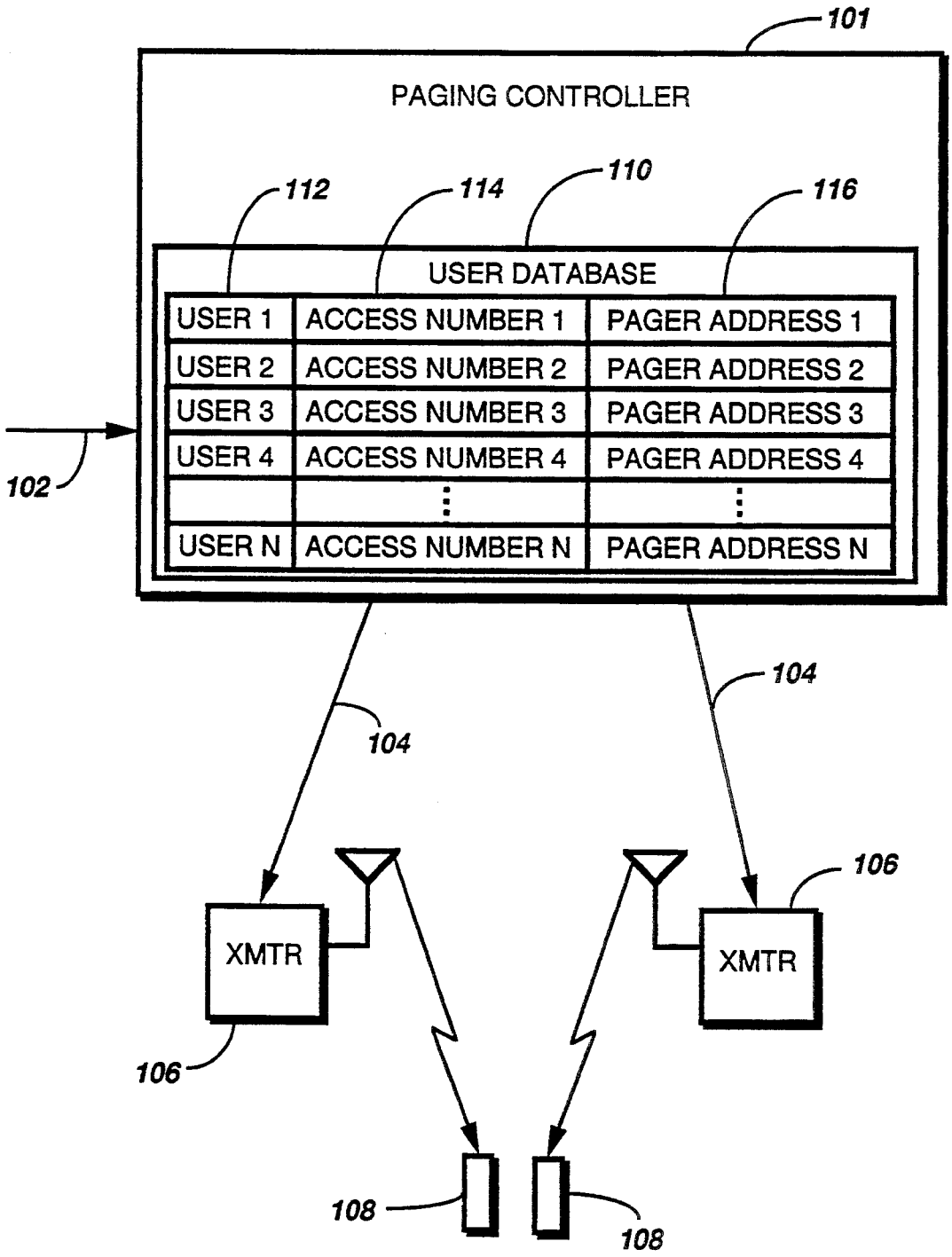
FIG. 1 is an electrical block diagram of a communication system in accordance with the preferred embodiment of the present invention.

Referring to FIG. 1, an electrical block diagram of a communication system 100 in accordance with the preferred embodiment of the present invention comprises a paging controller 101 coupled to a telephone line 102 for receiving access numbers and messages from callers wishing to send the messages to selective call receivers 108. The paging controller 101 comprises a user database 110 preferably including identities of users 112, the users' associated access numbers 114, and associated pager addresses 116. When a caller dials a particular one of the access numbers 114 to send a message to a particular user 112, the paging controller accesses the database 110 to find the associated pager address 116, and then sends the address 116 and message over telephone lines 104 to paging transmitters 106, which further send the address 116 and message by radio signals to the selective call receivers 108. A selective call receiver 108 which is programmed to respond to a selective call address matching the sent pager address 116 then responds to the page by alerting and conveying the message to the user 112 according to response options also programmed into the selective call receiver 108.

Preferably, the paging controller 101 is a model E09-PED0552 PageBridge® paging terminal, the paging transmitter 106 is a model C73 PURC 5000® transmitter, and the selective call receiver 108 is a model A03KLB5962CA ADVISOR® selective call receiver, all manufactured by Motorola, Inc. of Schaumburg, Ill. It will be appreciated that other similar equipment may be used as well to construct the communication system 100.

Figure 2:
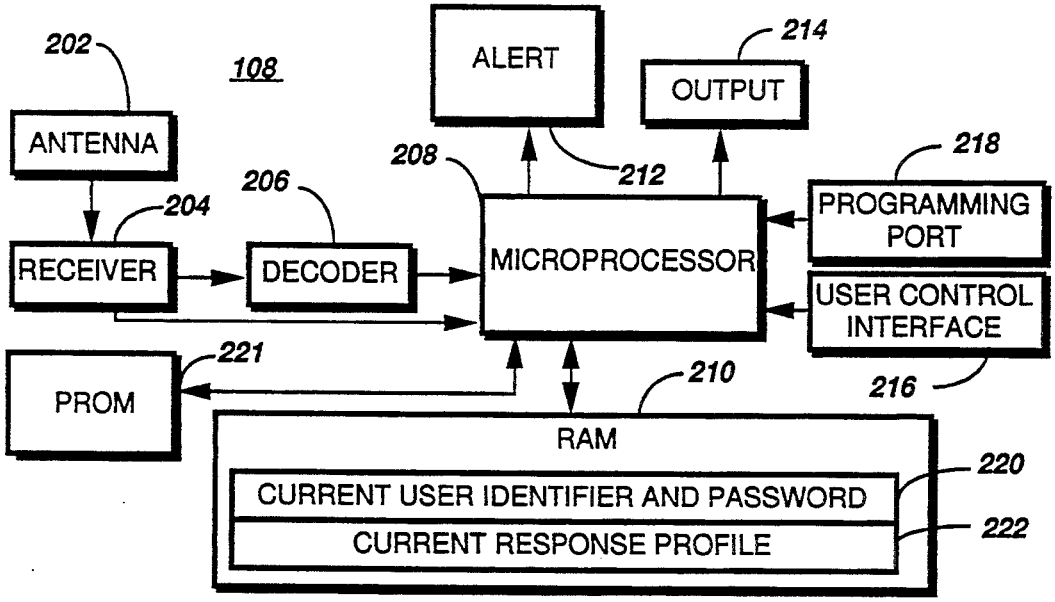
FIG. 2 is an electrical block diagram of a selective call receiver in accordance with the preferred embodiment of the present invention.

Referring to FIG. 2, an electrical block diagram of the selective call receiver 108 in accordance with the preferred embodiment of the present invention comprises an antenna 202 for intercepting the radio signals comprising the page. The antenna 202 is coupled to a receiver 204 for receiving and demodulating the radio signals intercepted. A decoder 206 is coupled to the receiver 204 for decoding a demodulated address transmitted in any of a number of well-known signaling protocols, such as POCSAG or GSC selective call signaling. A microprocessor 208, e.g., the MC68HC05C8 or C11 series microcomputers manufactured by Motorola, Inc. of Schaumburg, Ill., is also coupled to the receiver 204 for processing the demodulated information to derive the message. The microprocessor 208 is responsive to the decoder 206 and is coupled to a random access memory (RAM) 210 for storing recovered information having an address assigned to the communication receiver 108. The RAM 210 comprises values for a current user identifier and a password 220, and a current response profile 222, comprising a selective call address to which the selective call receiver 108 will respond, and response options therefor. An alert generator 212 is coupled to the microprocessor 208 for providing an audible or tactile alert to a user when the microprocessor 208 has the message ready for presentation.

An output device 214 comprises a visual display or an audio transducer or both, the output device 214 also being controlled by the microprocessor 208. A user control interface 216 comprises user accessible controls for allowing the user to command the microprocessor 208 to perform the selective call receiver operations well known to one of ordinary skill in the art, and typically includes control switches such as an on/off control button, a function control, etc. Alternatively, the user control interface can include a voice recognition apparatus for interfacing with the user. In addition, there is a programming port 218, e.g., a serial data port, such as is available on the ADVISOR® selective call receiver referenced herein above, for programing the selective call receiver in accordance with the preferred embodiment of the present invention.

The microprocessor 208 is coupled to a programmable read-only memory (PROM) 221 comprising special processor elements, i.e., firmware elements, in accordance with the preferred embodiment of the present invention. The firmware elements are described herein below in the discussion of FIG. 3. It will be appreciated that the functions of the decoder 206, the RAM 210, and part or all of the PROM 221 may be incorporated into the microprocessor 208 as well, as contiguous components thereof. It will be further appreciated that other types of non-volatile memory, e.g., electrically-erasable programmable read-only memory (EEPROM), may be used as well for the PROM 221.

Figure 3:
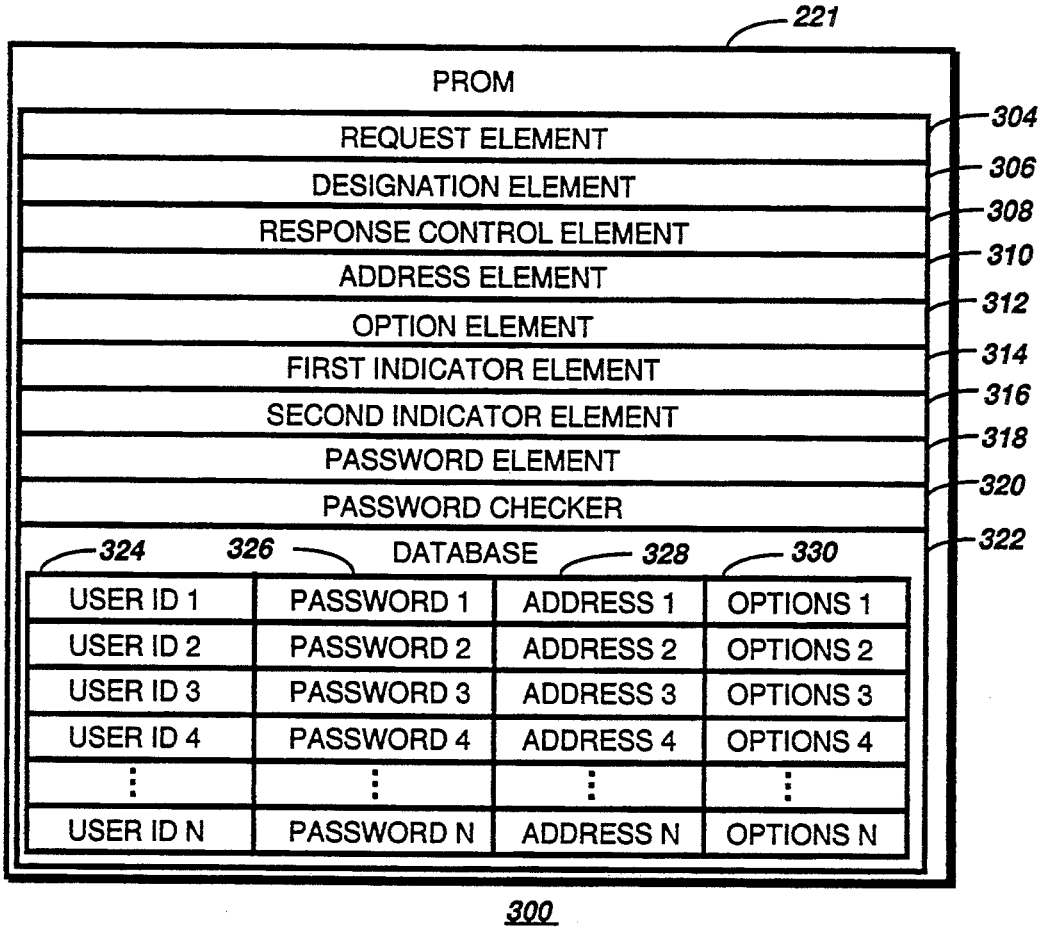
FIG. 3 is a firmware diagram depicting firmware elements in the selective call receiver in accordance with the preferred embodiment of the present invention.

Referring to FIG. 3, a firmware diagram 300 depicts firmware elements in the PROM 221 of the selective call receiver 108 in accordance with the preferred embodiment of the present invention. The firmware diagram 300 comprises a request element 304 for requesting a user to designate a user identifier, e.g., a name or number uniquely associated with the user, and a designation element 306 for facilitating the designation of the user identifier through the user control interface 216. A response control element 308 is provided for controlling the selective call receiver 108 to respond in accordance with a response profile associated with the designated user identifier. In addition, an address element 310 is provided for including an address within the response profile. An option element 312 is provided for including user-selectable response options within the response profile. The response options can include such features as a custom alert tone sequence, a silent vibratory alert, and output functionality, such as tone-only, voice, or display functionality.

The firmware diagram 300 also includes a first indicator element 314 for indicating a need for designation of the user identifier in response to a command sequence entered through the user control interface. A second indicator element 316 is provided for indicating a need for designation of the user identifier in response to application of power to the selective call receiver. In addition, a password element 318 is provided for preprogramming the PROM 221 with a password associated with a user identifier. A password checker 320 is provided for requiring the password to be designated correctly before activating the response profile. A database 322 is provided, which comprises a pre-programmed list of user identifiers 324, associated passwords 326, and associated response profiles, comprising selective call addresses 328, and response options 330.

When the selective call receiver 108 is put into service, the service provider preferably couples a personal computer 504 (FIG. 5) through a programming interface 500 (FIG. 5) to the programming port 218 to pre-program the database 322 with user identifiers 324 for all users who may have occasion to use the selective call receiver 108. If desired, the service provider can optionally pre-program a password 326 for some or all of the users. In addition, the service provider pre-programs for all the users the response profiles comprising a selective call address 328 and response options 330 associated with each user identifier 324. Pre-programming apparatus and its use will be further described herein below in reference to FIG. 5.

When all the selective call receivers 108 used in the system have been fully pre-programmed with all the custom response options required by all the users, any selective call receiver 108 advantageously can be made to assume a response characteristic, i.e., selective call address and custom response options, associated with any user on the system. In accordance with the preferred embodiment of the present invention, a requirement no longer exists for the user to locate a particular selective call receiver programmed specifically and only for that one user, as in the prior art. This removes the problems described herein above in the Background regarding the use of shared selective call receivers.

Figure 4:
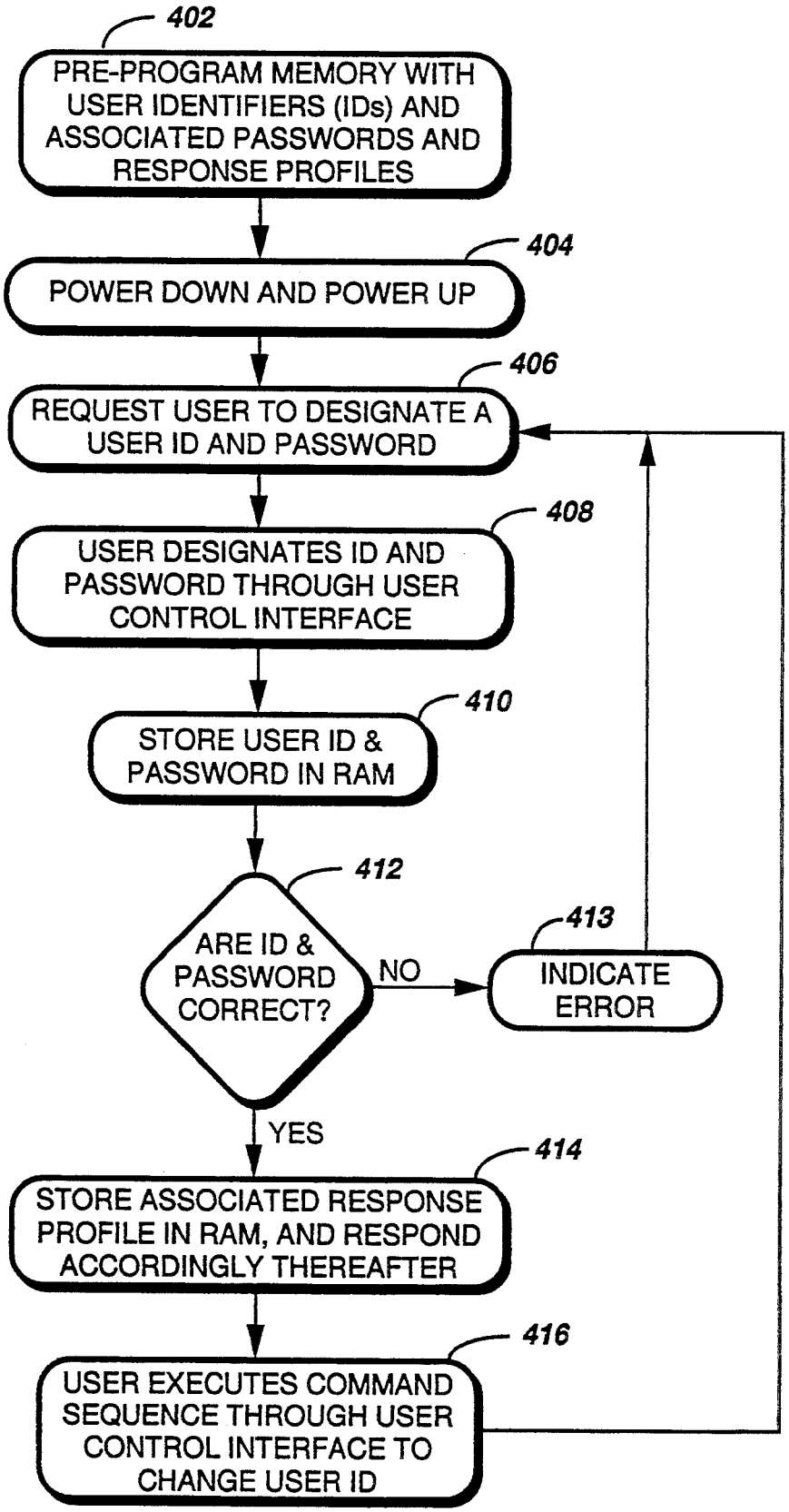
FIG. 4 is a flow chart depicting operation of a selective call receiver in accordance with the preferred embodiment of the present invention.

Referring to FIG. 4, a flow chart depicting operation of a selective call receiver 108 in accordance with the preferred embodiment of the present invention begins with the service provider pre-programming 402 the database 322 of the PROM 221 with the user identifiers 324, optional passwords 326, and response profiles, comprising the selective call addresses 328 and the response options 330. During the pre-programming process the microprocessor 208 accesses the address element 310, the option element 312, and (optionally) the password element 318 to facilitate the pre-programming process. Next, the selective call receiver 108 is powered down and subsequently powered up 404 by the user. In response to the power up, the microprocessor 208 accesses the first indicator element 314 and the request element 304 to request by the output device 214 the user to designate 406 a user identifier and (optional) password. The user then operates the user control interface 216 to designate 408 the user identifier and password, facilitated by the designation element 306 of the firmware. Preferably, the user designates the user identifier and password by scrolling a cursor through a field of characters and selecting individual characters in the field. It will be appreciated that other designation procedures, e.g., direct keyboard entry or voice recognition, can be used as well, depending on the type of user control interface 216. Next, the microprocessor 208 stores 410 the designated user identifier and password (if applicable) in the RAM 210 as the current user identifier and password 220.

Next, the microprocessor 208 accesses the database 322 to locate the matching user identifier 324 and password 326 to check 412 whether the designated user identifier and password are correct. If a password was entered, the microprocessor 208 accesses the password checker 320 to check the password. If the designated user identifier cannot be matched, or if it requires a password that was not supplied or was supplied incorrectly, then the microprocessor 208 indicates 413 an error by the output device 214, and returns to step 406 to request a new user identifier and password. If, on the other hand, at step 412 the microprocessor 208 finds the designated user identifier and password to be correct, then the microprocessor 208 stores 414 the associated response profile, comprising the selective call address 328 and the response options 330 in the RAM 210 as the current response profile 222. Thereafter, the microprocessor 208 accesses the response control element 308 for controlling the selective call receiver 108 to respond to the RAM-stored selective call address 328 in accordance with the RAM-stored response options 330.

Without further user action, the flow ends with step 414. However, if the user executes 416 a command sequence through the user control interface 216 indicating that the user desires to change the designated user identifier, then the microprocessor accesses the second indicator element 316 and the request element 304, and the flow returns to step 406 to request a new user identifier and password.

Figure 5:
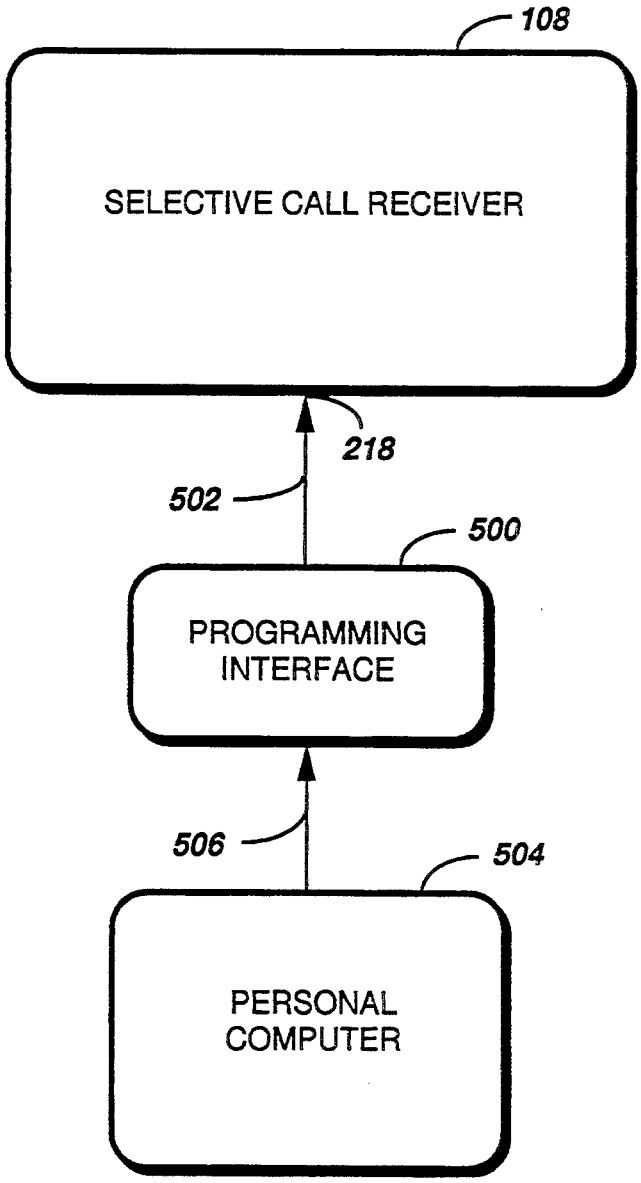
FIG. 5 is an electrical block diagram of the selective call receiver coupled to a personal computer through a programming interface in accordance with the preferred embodiment of the present invention.

Referring to FIG. 5, an electrical block diagram of the selective call receiver 108 coupled to the personal computer 504 through the programming interface 500 in accordance with the preferred embodiment of the present invention depicts a programming output bus 502 electrically connected to the programming port 218 for programming the PROM 221 of the selective call receiver 108. The programming interface 500 is coupled to the personal computer 504 by a standard RS-232 link 506. The programming interface 500 is preferably an NLN8813A programming interface box, manufactured by Motorola, Inc. of Schaumburg, Ill. The personal computer is preferably an IBM-compatible computer. It will be appreciated that other similar personal computers and programming interfaces can be used as well to program the selective call receiver 108.

To place a new selective call receiver 108 into service, the service provider downloads data from the personal computer 504 to the selective call receiver 108 to pre-program the selective call receiver. The downloaded data comprises the pre-programmed list of user identifiers 324, associated passwords 326, and associated response profiles, including the selective call addresses 328, and the response options 330.

Thus, the present invention provides a method and apparatus that allow a plurality of selective call receivers to be shared by a plurality of users, while eliminating the need for each user to locate and use a specific one of the plurality of selective call receivers. The present invention advantageously allows each selective call receiver to be instantly tailored by the user to the unique selective call address and response options of the user in response to the user's designating an appropriate user identity. The ability to freely interchange selective call receivers at will among all users, as provided by the present invention, eliminates the administrative difficulties that have accompanied the shared use of conventional selective call receivers.

What is claimed is:

1. A method of pre-programming and subsequently designating a response characteristic of a selective call receiver having a memory and a user control interface, the method comprising the steps of:

pre-programming the memory to store a plurality of user names and corresponding response profiles, each response profile comprising a selective call address and response options associated therewith;

thereafter requesting designation of a user name;

designating in response thereto a user name through the user control interface; and controlling the selective call receiver to respond in accordance with the pre-programmed response profile corresponding to the designated user name.

2. The method of claim 1, wherein the response options comprise a table of characteristics selected from ones of a group consisting of alerts and output functionalities.

3. The method of claim 1, wherein the designating step comprises the step of replacing a previously designated user name with a new user name, and wherein the controlling step thereafter controls the selective call receiver to respond in accordance with the pre-programmed response profile corresponding to the new user name.

4. The method of claim 1, wherein the pre-programming step comprises the step of storing a user name and corresponding response profile for every potential user of the selective call receiver.

5. The method of claim 1, wherein the requesting step comprises the step of indicating a need for designation of the user name in response to a command sequence entered through the user control interface.

6. The method of claim 1, wherein the requesting step comprises the step of indicating a need for designation of the user name in response to application of power to the selective call receiver.

7. The method of claim 1, wherein the pre-programming step comprises the step of storing a password associated with the user name.

8. The method of claim 7, wherein the controlling step comprises the step of requiring the password to be designated correctly before activating the pre-programmed response profile.

9. An apparatus for enabling pre-programming and user designation of a response characteristic of a selective call receiver having a memory and a user control interface, the apparatus comprising:

programming means for coupling the selective call receiver to a programmer for pre-programming the memory to store a plurality of user names and corresponding response profiles, each response profile comprising a selective call address and response options associated therewith;

request means within the selective call receiver for requesting designation of a user name;

designation means coupled to the request means for designating a user name through the user control interface; and control means coupled to the designation means for controlling the selective call receiver to respond in accordance with the pre-programmed response profile corresponding to the designated user name.

10. The apparatus of claim 9, wherein the response options comprise a table of characteristics selected from ones of a group consisting of alerts and output functionalities.

11. The apparatus of claim 9, further comprising means for replacing a previously designated user name with a new user name, and wherein the controlling step thereafter controls the selective call receiver to respond in accordance with the pre-programmed response profile corresponding to the new user name.

12. The apparatus of claim 9, further comprising means for storing a user name and corresponding response profile for every potential user of the selective call receiver.

13. The apparatus of claim 9, further comprising means for indicating a need for designation of the user name in response to a command sequence entered through the user control interface.

14. The apparatus of claim 9, further comprising means for indicating a need for designation of the user name in response to application of power to the selective call receiver.

15. The apparatus of claim 9, further comprising means for pre-programming the memory to store a password associated with the user name.

16. The apparatus of claim 15, further comprising password checker means for requiring the password to be designated correctly before activating the pre-programmed response profile.

17. A selective call receiver, comprising:

a receiver element for receiving radio signals including a selective call address;

a processor coupled to the receiver element for decoding the received selective call address;

a memory system coupled to the processor for storing pre-programmed data and operational variables;

a user control interface coupled to the processor for providing control of the selective call receiver by a user;

an alert element coupled to the processor for alerting the user in response to the received selective call address; and an apparatus for enabling pre-programming and user designation of a response characteristic of the selective call receiver, the apparatus comprising:

a programming port coupled to the processor for coupling the processor to an external programmer to pre-program the memory system with a plurality of user names and corresponding response profiles, each response profile comprising a selective call address and response options associated therewith;

a request element coupled to the processor for requesting designation of a user name;

a designation element coupled to the request element for designating a user name through the user control interface; and a response control element coupled to the designation element for controlling the selective call receiver to respond in accordance with the pre-programmed response profile corresponding to the designated user name.

18. The selective call receiver of claim 17, wherein the received radio signals further include information, and wherein the processor processes the received information, and wherein the selective call receiver further comprises an output element coupled to the processor for outputting the received information.

19. The selective call receiver of claim 17, wherein the response options comprise a table of characteristics selected from ones of a group consisting of alerts and output functionalities.

20. The selective call receiver of claim 17, further comprising means for replacing a previously designated user name with a new user name, and wherein the controlling step thereafter controls the selective call receiver to respond in accordance with the pre-programmed response profile corresponding to the new user name.

21. The selective call receiver of claim 17, further comprising means for storing a user name and corresponding response profile for every potential user of the selective call receiver.

22. The selective call receiver of claim 17, further comprising a first indicator element for indicating a need for designation of the user name in response to a command sequence entered through the user control interface.

23. The selective call receiver of claim 17, further comprising a second indicator element for indicating a need for designation of the user name in response to application of power to the selective call receiver.

24. The selective call receiver of claim 17, further comprising a password element for pre-programming the memory system with a password associated with the user name.

25. The selective call receiver of claim 24, further comprising a password checker for requiring the password to be designated correctly before activating the pre-programmed response profile.

* * * * *